US009970250B2

(12) United States Patent
Hess et al.

(10) Patent No.: US 9,970,250 B2
(45) Date of Patent: May 15, 2018

(54) RETRIEVABLE ELECTRICAL SUBMERSIBLE PUMP

(71) Applicant: Halliburton Energy Services, Inc., Houston, TX (US)

(72) Inventors: Joe Eli Hess, Wasilla, AK (US); Richard Thomas Hay, Spring, TX (US); Jody Ray McGlothen, Waxahachie, TX (US); Gary Lorne Donison, Sherwood Park (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days. days.

(21) Appl. No.: 14/903,968

(22) PCT Filed: Aug. 15, 2013

(86) PCT No.: PCT/US2013/055158

§ 371 (c)(1),
(2) Date: Jan. 8, 2016

(87) PCT Pub. No.: WO2015/023282

PCT Pub. Date: Feb. 19, 2015

(65) Prior Publication Data

US 2016/0168937 A1 Jun. 16, 2016

(51) Int. Cl.

| | |
|---|---|
| ***E21B 23/01*** | (2006.01) |
| ***E21B 33/12*** | (2006.01) |
| ***E21B 43/12*** | (2006.01) |
| ***E21B 17/02*** | (2006.01) |
| ***F04D 13/10*** | (2006.01) |

(52) U.S. Cl.
CPC ..... *E21B 23/01* (2013.01); *E21B 17/028* (2013.01); *E21B 33/12* (2013.01); *E21B 43/128* (2013.01); *F04D 13/10* (2013.01)

(58) Field of Classification Search
CPC ..... E21B 17/028; E21B 23/01; E21B 33/12; E21B 43/128; F04D 13/10
See application file for complete search history.

(56) References Cited

U.S. PATENT DOCUMENTS

| | | | | |
|---|---|---|---|---|
| 4,690,212 A * | 9/1987 | Termohlen | ..... | H01R 13/523 166/65.1 |
| 4,921,438 A | 5/1990 | Godfrey et al. | | |
| 5,304,073 A * | 4/1994 | Golobay | ..... | E21B 17/028 439/282 |

(Continued)

OTHER PUBLICATIONS

International Preliminary Report on Patentability issued in related PCT application No. PCT/US2013/055158, dated Feb. 25, 2016. 10 pages.

(Continued)

*Primary Examiner* — James G Sayre
(74) *Attorney, Agent, or Firm* — John W. Wustenberg; Baker Botts L.L.P.

(57) ABSTRACT

A retrievable Electrical Submersible Pump (ESP) and electrical motor for driving the ESP are positioned in a tubing string in the wellbore and, when desired, retrieved back to the surface. The ESP and motor are on an insertion string and can be lowered using wireline, coiled tubing, and standard running and setting tools. The method eliminates the need to retrieve the tubing string to repair, replace, or service the ESP and motor.

22 Claims, 5 Drawing Sheets

(56) References Cited

U.S. PATENT DOCUMENTS

| | | | | |
|---|---|---|---|---|
| 5,746,582 | A * | 5/1998 | Patterson | E21B 23/02 166/377 |
| 5,906,242 | A * | 5/1999 | Bruewer | E21B 17/003 166/378 |
| 6,641,434 | B2 * | 11/2003 | Boyle | E21B 17/028 166/242.6 |
| 2001/0050173 | A1 * | 12/2001 | Head | E21B 17/003 166/381 |
| 2006/0243450 | A1 | 11/2006 | Head | |
| 2007/0081768 | A1 | 4/2007 | Grigsby et al. | |
| 2009/0242212 | A1 * | 10/2009 | Shaw | E21B 43/128 166/378 |
| 2010/0243264 | A1 * | 9/2010 | Tetzlaff | E21B 17/023 166/369 |

OTHER PUBLICATIONS

International Search Report and Written Opinion issued in related PCT Application No. PCT/US2013/055158 dated Apr. 28, 2014, 12 pages.

* cited by examiner

RETRIEVABLE ELECTRICAL SUBMERSIBLE PUMP

CROSS-REFERENCE TO RELATED APPLICATION

The present application is a U.S. National Stage Application of International Application No. PCT/US2013/055158 filed Aug. 15, 2013, which is incorporated herein by reference in its entirety for all purposes.

FIELD OF INVENTION

Generally, the disclosure relates to operations in a hydrocarbon well. More particularly, the disclosure relates to methods and apparatus for retrieving and re-inserting an electrical submersible pump (ESP) via a tubing string.

BACKGROUND OF INVENTION

Electrical submersible pumps are used in the oil and gas production industry to pump production and other fluids upwards in the wellbore in deep water applications. Some large ESPs are capable of pumping up to about 40,000 barrels per day depending on conditions and pump specifications. For various reasons, it becomes necessary to retrieve an ESP from its downhole location for repair, replacement, etc. Retrieving ESPs is relatively expensive as it involves the services of a rig. Further, in some locations, such as Alaska, a typical work-over to change out the ESP can cost as much as $1.5 million. Reduction of this expense, obviously, is desirable.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

DETAILED DESCRIPTION OF PREFERRED EMBODIMENTS

While the making and using of various embodiments of the present invention are discussed in detail below, a practitioner of the art will appreciate that the present invention provides concepts which can be embodied in a variety of specific contexts. The specific embodiments discussed are illustrative of specific ways to make and use the disclosed apparatus and do not limit the scope of the appended claims.

The description may be discussed with reference to a horizontal wellbore. However, the inventions disclosed herein can be used in horizontal, vertical, or deviated wellbores. As used herein, the words "comprise," "have," "include," and grammatical variations have open, non-limiting meanings that do not exclude additional elements or steps. The terms "uphole," "downhole," and the like, refer to movement towards or away from the wellhead, or in a direction closer or farther from the wellhead, irrespective of whether used in reference to a vertical, horizontal or deviated borehole. The terms "upstream" and "downstream" refer to the relative position or direction in relation to fluid flow, again irrespective of the borehole orientation. Those of skill in the art will recognize where the inventions disclosed herein can be used in conjunction with jointed tubing string, coiled tubing, or wireline. The inventions herein can also be used with on-shore rigs, off-shore rigs, subsea and deep-sea rigs, etc.

Figure 1:
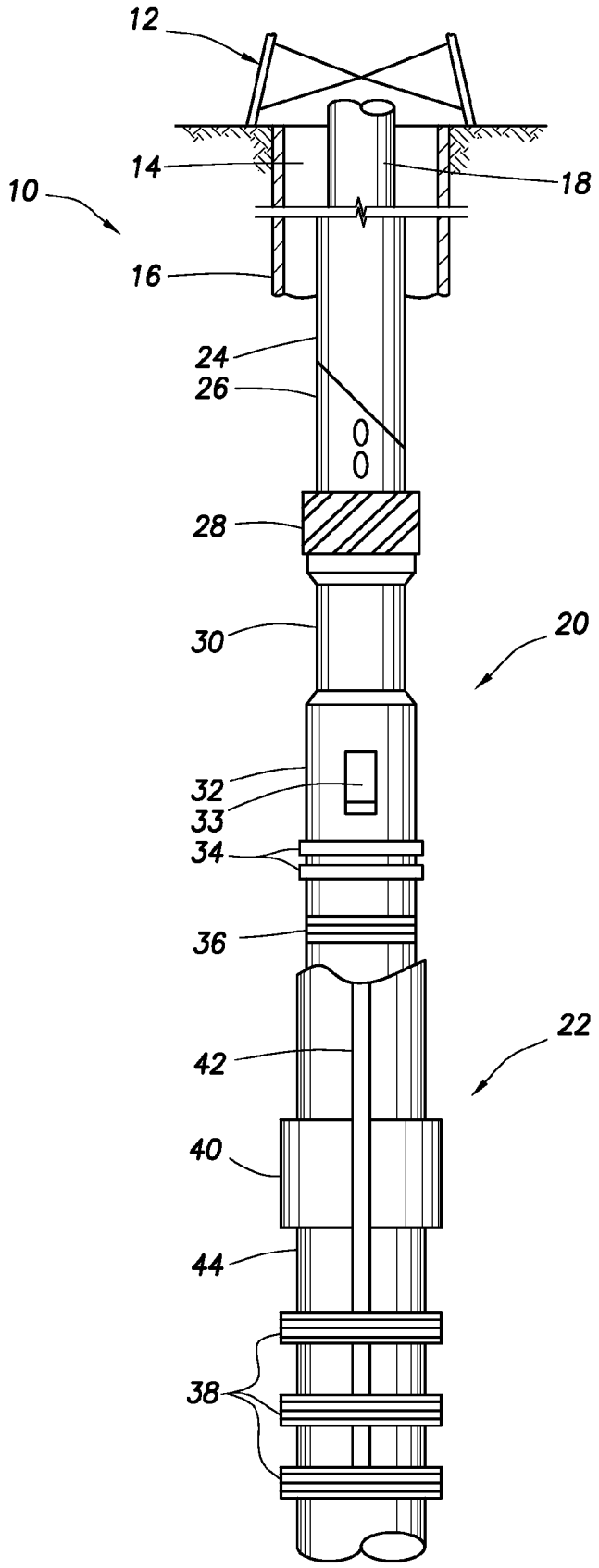
FIG. 1 is a schematic view of an exemplary embodiment of a tubing string for insertion of an ESP having a secondary winding according to an aspect of the invention.

Referring to FIG. 1, a general schematic of an oil or gas well is generally designated 10. A derrick 12, rig, platform, hoist, hook and swivel, or other surface equipment and machinery are generally indicated positioned over a wellbore 14. The type of uphole equipment depends on the circumstances, as is apparent to those of skill in the art, including whether it is an on-shore or off-shore well, the operations being performed (drilling, work-over, production, injection, etc.), the specifics of the well, such as depth, orientation (vertical, deviated, horizontal), expected hydrocarbon and other fluid production, operating conditions such as temperature, wellbore pressure, and formation pressure, etc. Further, various additional devices can be deployed, such as blow-out preventers, Christmas tree, wellhead stacks, safety valves and seals, isolation devices, etc. The wellbore 14 can have a casing 16, that is, be cased, open-hole, or a combination of both. The wellbore extends through various earth strata, including a hydrocarbon-bearing formation.

A coiled tubing 18 is used to run-in an insertion string 20 for performing downhole operations, such as, in this case, placement or retrieval of a downhole ESP and associated equipment. It is understood that these apparatus are exemplary and that the methods and apparatus herein can be used with coiled tubing, slick-line, braided line, wire rope, wireline, or jointed tubing string. The insertion string 20 is for insertion into a larger diameter tubing string 22 already positioned downhole in the wellbore. The insertion and tubing strings will be discussed in detail below.

The insertion string 20 is suspended from coiled tubing 18, preferably having a hydraulic retrieving tool (HRT) 24, such as is commercially available from Sperry Drilling Services, a division of Halliburton Energy Services, Inc., attached thereto. The HRT 24 is mated to an orientation retrieval sub 26 at the upper end of the insertion string. Also seen in FIG. 1 on the insertion string 20 are an annular isolation device 28, such as a packer, an emergency disconnect assembly 30, a latching assembly 32 (e.g., collet assembly), an interior locking assembly 33 (e.g., locking mandrel) exterior annular seals 34, and inner transformer windings 36. Additional tools and elements can be included on the insertion string. The illustrated string is merely an example and is not limiting.

Exemplary annular isolation devices include mechanically, hydraulically, electromechanically, chemically, or temperature-activated packers, plugs, etc., as are known in the art. The annular sealing devices can be used to isolate formation zones, or sections of wellbore, for interval treatment, etc. The packers are disposed about the tubing string and selected to seal the annulus between the tubing string and the wellbore wall, when the assembly is disposed in the wellbore. Several compatible packer designs are commercially available. If the conveyance used is coiled tubing, there are multiple methods for setting the packer. One method is to inflate the packer using the pumps. Another method is to place weight-down on the packer using the coiled tubing, to cause the packer to set. The setting weight can be selected such that the packer expands and sets at a selected place in the sequence of events during positioning of the insertion string in the tubing string. Another method uses a combination of pumps and weight-down to set or lock the packer in the expanded position. All of these options are reversible, and the packer can be unlocked, or un-set, for later retrieval of the insertion string.

The insertion string is shown partially inserted into tubing string 22, which is, in the embodiment shown, already positioned and anchored in the wellbore. The tubing string can include outer transformer windings 38, landing collar 40, power cable 42, housing 44, and additional tools and elements, such as are known in the art.

As used herein, tubing string, work string, insertion string, and the like are used broadly, and are to be construed as inclusive of various types of string or strings for various operations, such as work work-overs, servicing, production, injection, stimulation, etc. Presented are two primary tubing string configurations for use in performing the retrieval or insertion of an ESP and associated equipment. These embodiments are representative and not limiting. Those of skill in the art will recognize alternative embodiments and variations which are applicable.

Application of the methods and apparatus disclosed herein is designed to greatly reduce rig time and costs associated with the retrieval and/or insertion of an ESP and motor through the use of a wireline unit, coiled tubing unit, or other units as mentioned elsewhere herein.

Figure 2:
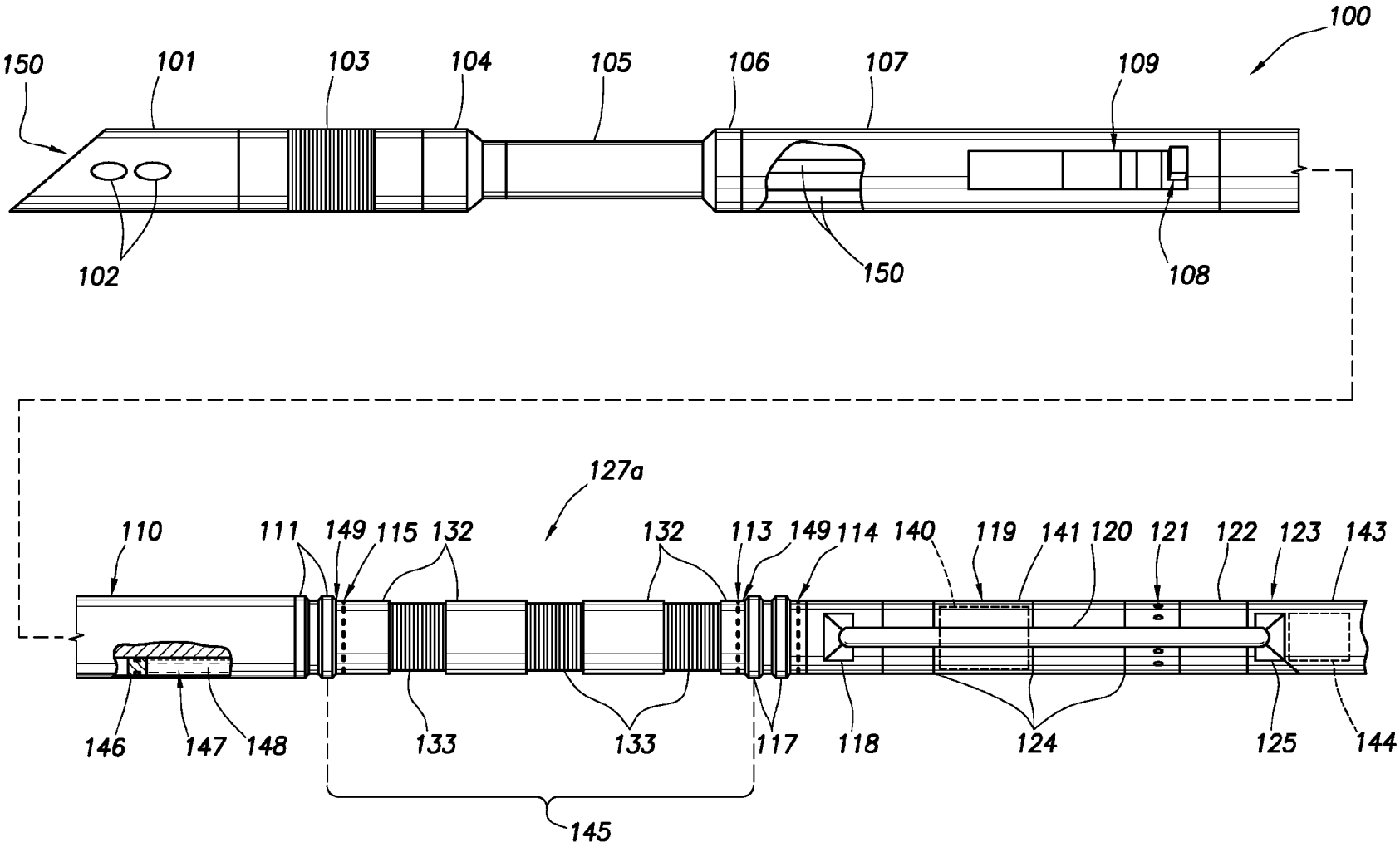
FIG. 2 is a schematic view of a tubing string with landing collar and primary winding according to an aspect of the invention.
Figure 3:
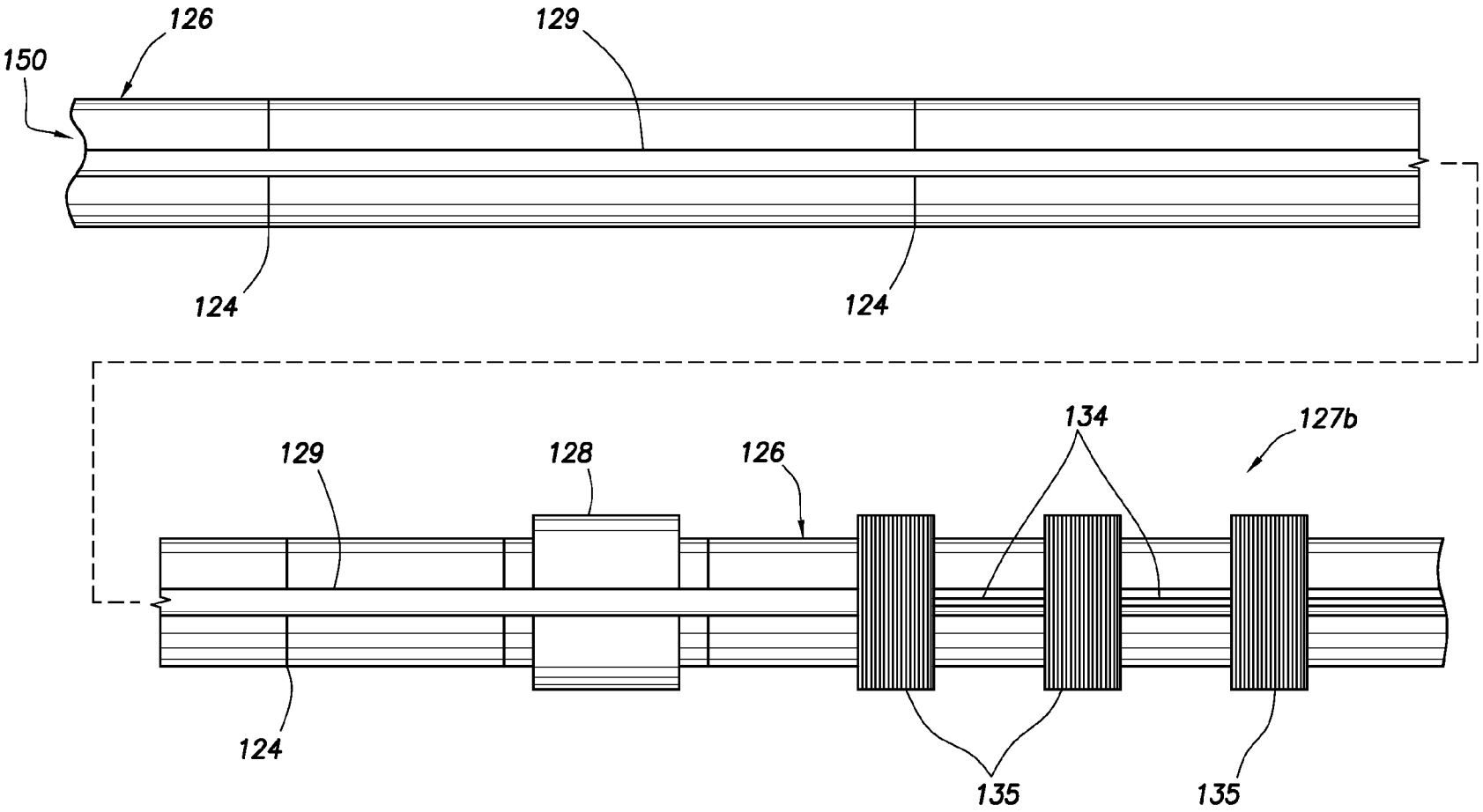
FIG. 3 is a schematic view of a tubing string for tool insertion having a secondary wet-connect according to an aspect of the invention.

FIGS. 2 and 3 present an exemplary embodiment of the disclosed apparatus seen in a schematic view. The figures are discussed in conjunction. The configuration consists of an inductive coupling, or transformer, to jump electromagnetic energy from the outer, or primary, tubing side to the inner, or secondary, insertion string side.

FIG. 2 is a schematic view of an exemplary embodiment of an insertion string 100 for inserting an ESP assembly 119, including an ESP 140, and electric motor assembly 123, into a tubing string 126 at a downhole location, the insertion string having an inner or secondary transformer winding. FIG. 3 is a schematic view of a tubing string 126 with landing collar sub 128 and outer or primary transformer windings 135 for use in conjunction with the insertion string 100 of FIG. 2.

FIG. 2 shows an exemplary insertion string 100. At its upper end, the string includes a connector assembly 101 for connecting the insertion string to a conveyance device, such as a wireline, slick-line, jointed tubing string, etc., typically via a setting or running tool. The connection can be made to additional downhole tools, such as standard MLT running tools such as a hydraulic retrieval tool (HRT), or standard wireline or slick-line setting tools. In the preferred embodiment, the connector assembly is an orientation, retrieval sub 101 having an orientation mechanism, such as the angled upper surface or mule shoe. The sub connects to the conveyance mechanism by keyhole ports 102 which cooperate with radially extending dogs on the connecting tool above.

An annular isolation device 103 is positioned on the exterior of the insertion string assembly and, upon activation or setting, expands radially to seal and grip the tubing string. The annular isolation device provides a pressure seal across the annulus defined between the insertion string and the tubing string. Annular isolation devices include packers, inflatable packers, swellable packers, etc., and can employ one or more sealing elements, typically but not necessarily of elastomeric material, and gripping mechanisms such as radially expandable grips. Such devices are known in the art.

In a preferred embodiment, the insertion string is provided with one or more emergency or alternate disconnect assemblies 105, which can be attached via adapter subs 104 and 106. Emergency or contingency disconnection assemblies are known in the art by persons of skill in the art.

A latching assembly 107 is provided for selectively attaching the insertion string to the tubing string. Latching assemblies are known in the art and include expandable collets, spring-loaded locking or mating dogs, snap rings, split rings, cooperating profiles, etc., and also include various anchoring mechanisms. In a preferred embodiment, the latching assembly is a collet assembly. The collet assembly includes a radially adjusting collet 108. An internal, locking mandrel 109 serves to selectively lock the set collet into place, anchored or attached to the tubing string. Preferably the locking mandrel 109 has longitudinally extending splines 150 which cooperate with splines defined on the interior of the collet housing. The splines cooperate to prevent relative rotation of the housing and mandrel in response to torque placed on the assembly, for example, by the operation of the motor 144.

Annular seals 111 and 117 are positioned or defined on the exterior of the insertion assembly. The seals cooperate with the interior surface of the tubing string, profiles defined thereon, or cooperating seals positioned therein. Alternately, the seals can be carried on the interior of the tubing string. The seals operate to define a protective chamber 145, shown as extending longitudinally along bracket 145, for the windings, after they are positioned sealingly in the tubing string. The protective chamber 145 is defined in the annulus between the insertion and tubing strings and at each end by the seals 111 and 117. Consequently, the chamber runs longitudinally across one or more interior transformer windings 133. The protective chamber is preferably filled with a non-conductive and non-corrosive fluid to extend the longevity of the windings. Further, although the outer transformer windings 135 are shown wrapped on the exterior of the tubing string for ease of reference, it is preferable to have the outer windings located inside the tubing string such that they are also surrounded by the non-conductive and non-corrosive fluid. Typically, the windings are impregnated with a high-temperature, injectable plastic, resin, or elastomer, such as Arion (trade name), epoxy, or highly saturated nitrile rubber, or other such sealant, that acts as a primary barrier to the wellbore fluids.

In a preferred embodiment, the insertion string includes a fluid flush assembly 110 for flushing the cleansing or protective fluid, stored in a reservoir defined in the flush assembly, across the transformer windings 133 and filling the protective chamber 145. Entry for the fluid to the protective chamber is provided by a plurality of inlets 115. Outlets 113 are provided for the flushed wellbore fluid, which flows via internal passageway to exhaust ports 114. The flush assembly is preferably operated by driving an annular piston 146 to force the protective fluid 147 out of an annular reservoir 148 containing the fluid and into the protective chamber 145 via appropriate fluid passageways extending from reservoir to chamber.

The piston can be driven using weight-down on the coiled tubing string to shear a pin or other holding mechanism and move the piston. Alternately, the piston can be driven by hydraulic, mechanical, or electro-mechanical devices, such as, for example, those used in setting tools. The piston and other movable or settable devices described herein can also be powered by a local electro-mechanical device. Additionally, the protective fluid reservoir can be pre-pressurized to drain spontaneously into the protective chamber upon release of the pressure, such as by activation of a frangible or dissolvable barrier, plug or disk. Various washing assemblies are known in the art, to wash clean fluid, lubricating oil, dielectric fluid, etc., across a surface of interest, such as an electrical or fiber optic connection, a debris screen, or to re-fill a chamber. Persons of skill in the art will recognize various such assemblies which can be used. Methods and apparatus for actuating downhole components, including rupture disks, low force pistons, and the like, are disclosed in the following, each incorporated by reference for all purposes: U.S. Pat. No. 8,235,103, to Wright, issued Aug. 7, 2012; U.S. Patent Application Publication No. 2011/0174504, to Wright, filed Jan. 15, 2010; and U.S. Patent Application Publication No. 2011/0174484, to Wright, filed Dec. 11, 2010; U.S. Patent Publication No. 2011/0265987, to Wright, filed Apr. 28, 2010; and U.S. Patent Application Serial No. PCT/US12/53448 filed Aug. 31, 2012, to Fripp, et al.

The power coupling 127 is made-up of inner coupling member 127*a* and outer coupling member 127*b*. In reference to the windings, transformer members, and power coupling members, the terms interior and exterior refer to relative radial positions of the members. In the embodiment shown, the inner transformer windings 133 are wrapped on the exterior of the transformer housing 132 of the insertion string. The coupling member 127*a* is preferably defined along a radially decreased OD portion of the insertion string.

In use, the outer windings 135 are aligned with the inner windings 133 when the insertion string 100 is installed in the tubing string 126. This allows for coupling of electromagnetic energy between the windings. In general, the ratio between the turns of the outer and inner windings is 1:1. Other ratios can be used, for example, if it was desirable to adjust the downhole voltage delivery to the motor. In such a case, it may be desirable to transmit downhole with a higher voltage, and then step the voltage down with the transformer. This allows for a smaller cable to be run from the surface and reduces resistive losses associated with transmission over the interval, thus improving the efficiency of the power delivery system.

The transformer sub is connected, via electrical connector sub 118, to the ESP assembly 119. The ESP assembly 119 includes an ESP 140 positioned in an ESP sub housing 141. ESPs are known in the art, as well as means for operatively attaching them to an electrical motor, drive shaft, electrical cables, etc., and will not be discussed herein. Persons of skill in the art are aware of the types of and specifications for ESPs.

Power in the inner windings 133 is directed along a cable to the ESP motor 144 located near the bottom of the insertion string. The motor is electrically powered and drives a fluid ESP 140 that pumps surrounding fluid from the annulus exterior the pump housing, through intake ports 121, and up an interior passageway to the surface.

The electrical connector sub 118 connects the transformer assembly to an exterior power cable 120, held in place, if necessary, by cable straps 124. The power cable enters the motor housing 143 of the motor assembly 123 via electrical connector port 125 and electrically powers the electric motor 144.

The power cable 120, preferably, in this instance, a three-phase armored power cable, is run to the electrical connector port 125. The power cable is strapped, as necessary, to the insertion string using straps or steel bands 124 to hold the cable tightly to the insertion string. The other end of the power cable is connected to the electrical connector sub 118, which also preferably has an electrical connector for three-phase power. The cable runs interior to the transformer housing 132 and connects to the appropriate inner transformer windings 133. As with any three-phase power, the windings 133 can be wired in a delta or Y configuration. In this instance, the delta configuration is preferred, so as to float the grounding so it is not necessary to have an additional return ground-line. Other alternatives are available and are largely dependent on the ESP motor wiring. The three inner or secondary transformer windings are spaced apart enough that magnetic interference between the transformer solenoid-style windings are negligible.

Electric motors for use in powering ESPs are well known in the art by persons of skill therein. The ESP motor 144 is oil-filled and is preferably an induction style motor such as the motors supplied by the Wood Group PLC. Power is fed to the motor via the motor electrical connector port 125, in this case located on the outside of the housing.

The ESP motor assembly 123 it is connected to a rotary seal sub 122. The rotary seal sub ensures wellbore fluids do not enter the motor cavity, which is generally filled with oil. Such seal subs are known in the art and commercially available, such as from the Wood Group PLC. The shaft from the ESP motor runs through the seal sub and attaches to the ESP 140. The pump has fluid intake 121 above the seal sub 122. The tubular members in the insertion string above the pump are preferably through-bore, with an outlet at the upper end from the orientation retrieval sub 101.

The tubing string 126, seen in FIG. 3, is preferably previously positioned downhole and anchored or attached in place. The string can include various additional tools hanging below or extending above the illustrated portion of the string. Power lines 134 run from each outer winding 135 to the long-haul power cable 129. This power cable continues up to the surface, where it is ultimately connected to a power source that energizes the ESP motor 144. The long-haul power cable 129 is strapped to the outside of the tubing string 126 using straps or steel bands 124 at appropriate intervals, as necessary. The speed of the motor is generally adjusted at the surface by varying frequency and voltage levels. The power is typically a three-phase alternating current operating at 50 Hz or 60 Hz under normal load conditions.

The transformer windings 135 and 133 are shown wound in a solenoid-style arrangement. While this is the preferred method of coupling power from the exterior winding to the interior winding, other arrangements are possible which can effectively couple power across the windings. For example, longitudinal ribs with windings around the ribs could be employed to facilitate power transfer. While this style of winding can be done, it is not as easy to package in an environment where radial distance is limited.

Generally, the configuration shown in FIGS. 2 and 3 enables electrical power transference between a power cable 129 running along tubing string 126 from the surface and a power line 120 running along the insertion string 100 by way of a power coupling 127*a-b*. Electro-magnetic energy is transferred from the outer transformer windings 135 on the outer half 127*b* of the coupling to the inner transformer windings 133 on the inner half 127*a* of the power coupling 127. Power is transferred in the form of an alternating electric current through the outer windings which, in turn, excites current in the inner windings. The inner windings side 127*a* is connected to the retrievable, insertion string.

The insertion string operates to insert, retrieve, and re-insert the ESP and ESP motor as many times as necessary through the aid of standard MLT running tools, wireline setting tools, or slick-line setting tools. Generally ESPs last about 5 years between servicing, and in the event of sand ingression, servicing intervals can be reduced dramatically.

In use, the insertion string is placed in the tubing string utilizing, preferably, coiled tubing and a coiled tubing rig with a Sperry hydraulic retrieving tool (HRT). The HRT is connected to the coiled tubing, then engaged to the insertion string, preferably by mating retractable dogs on the HRT with the keyhole ports 102 on the orientation retrieval sub 101. The mule shoe at the upper end of the orientation retrieval sub allows the HRT to align with the keyholes for engagement.

The insertion string is tripped into the wellbore. Eventually the locking collet 108 lands in the landing sub 128. The collet 108, upon alignment with a cooperating profile, radially expands into engagement with the landing sub. The collet includes collet arms (or similar) which, in a radially expanded position, bear the weight of the coiled tubing.

The upper and lower seals 111 and 117 seal against the inner diameter surface of the tubing string 126, thereby forming the annular protective chamber 145 which extends along and encloses the inner windings 133. In a preferred embodiment, the outer windings 135 are carried on the interior of the tubing string and are also enclosed in the protective chamber 145. The protective chamber is isolated from wellbore fluids, however, the fluid in the chamber still contains wellbore fluids and needs to be flushed out and filled with a protective fluid.

When the locking collet 108 expands, a locking mandrel 109, mounted for longitudinal movement inside of the insertion string and connected to the upper end of the insertion string, slides underneath the collet fingers in response to weight applied by the coiled tubing, which increases to shear a shear pin holding the locking mandrel in place. The locking mandrel travels underneath the collet fingers, essentially "locking" the collet in the radially expanded and engaged position in the landing collar.

The mandrel continues to travel longitudinally and engages an annular piston 146. The piston is forced downward, thereby forcing protective fluid stored in an annular reservoir below the piston, to travel through a series of passageways and one-way valves. The flushing fluid enters the chamber 145 through the intake ports 115 which have one-way check valves 149 mounted in-line with them. The flushing fluid pushes the wellbore fluid in the chamber 145 out the exit ports 113, which also have one-way check valves 149 and debris screens in-line with them. Wellbore fluid is ejected out into the wellbore from the fluid exhaust ports 114. As a general rule of thumb, a minimum of three and preferably ten times the chamber volume of flushing fluid is flushed through the chamber to ensure proper flushing, although theoretically only one volume worth of flushing fluid is required.

The upper part of the locking mandrel 109 inside the collet housing has splines 150 which cooperate with corresponding features on the inner diameter of the collet housing. This prevents the lower assembly from rotating due to reactive torque put into the insertion string by the ESP motor 144.

When the stroke of the mandrel 109 is complete, weight from the coiled tubing piles-up on the through-bore packer 103 which is now in position to be set. The through-bore packer has a two main purposes. First, it seals the wellbore from the tubing string inner diameter above it. This allows fluid pumped by the ESP into the tubing string to remain in the tubing string and travel up the well. Second, the packer prevents the insertion string from rotating due to reactive torque from the ESP motor.

The MLT is then detached from the insertion string and pulled to the surface.

For retrieval, a coiled tubing (or alternate) is run-in the wellbore and attaches to the retrieval sub. Upward pull on the internal insertion string members basically reverses the steps described in conjunction with running-in and setting the insertion string. In some embodiments, an unlatching assembly can be operated by weight-down on the coiled tubing. The packer is radially retracted and un-set. Retrievable packers are known in the art. The locking mandrel is pulled from the collet assembly, allowing the collet arms to retract radially. The insertion string is pulled out of hole. Note that the piston and flushing fluid assemblies may not be affected by the removal method.

The ESP and ESP motor are pulled to the surface along with the insertion string. The process can be repeated as desired, allowing the ESP and ESP motor to be replaced, repaired, or otherwise treated, and then run-in and positioned in the tubing string. The method does not require tripping out and in the tubing string, which remains in place during the method.

Various patents describe mechanisms for setting, unsetting and retrieving downhole tools such as packers, including U.S. Pat. No. 4,151,875 to Sullaway, U.S. Pat. Nos. 5,224,540 and 5,271,468 to Streich, U.S. Pat. No. 5,727,632 to Richards, U.S. Pat. No. 7,080,693 to Walker, and U.S. Pat. No. 7,198,110 to Kilgore, which are incorporated by reference for all purposes. Further disclosure can be found in International Application PCT/2012/058242, filed Oct. 1, 2012, to Halliburton Energy Services, Inc., which is incorporated herein for all purposes. Latching mechanisms and methods which can be applied to the disclosure herein are disclosed in U.S. Pat. No. 5,579,829, issued Dec. 3, 1996, to Comeau, et. al., and U.S. Pat. No. 6,202,746, issued Mar. 20, 2001, to Vandenberg, et. al., which are incorporated herein by reference for all purposes. Disclosure regarding collet assemblies can be found in U.S. Patent Application Publication No. U.S. Pat. No. 8,485,266 B2, filed Nov. 11, 2011, to Stautzenberg, which is incorporated herein for all purposes.

Figure 4:
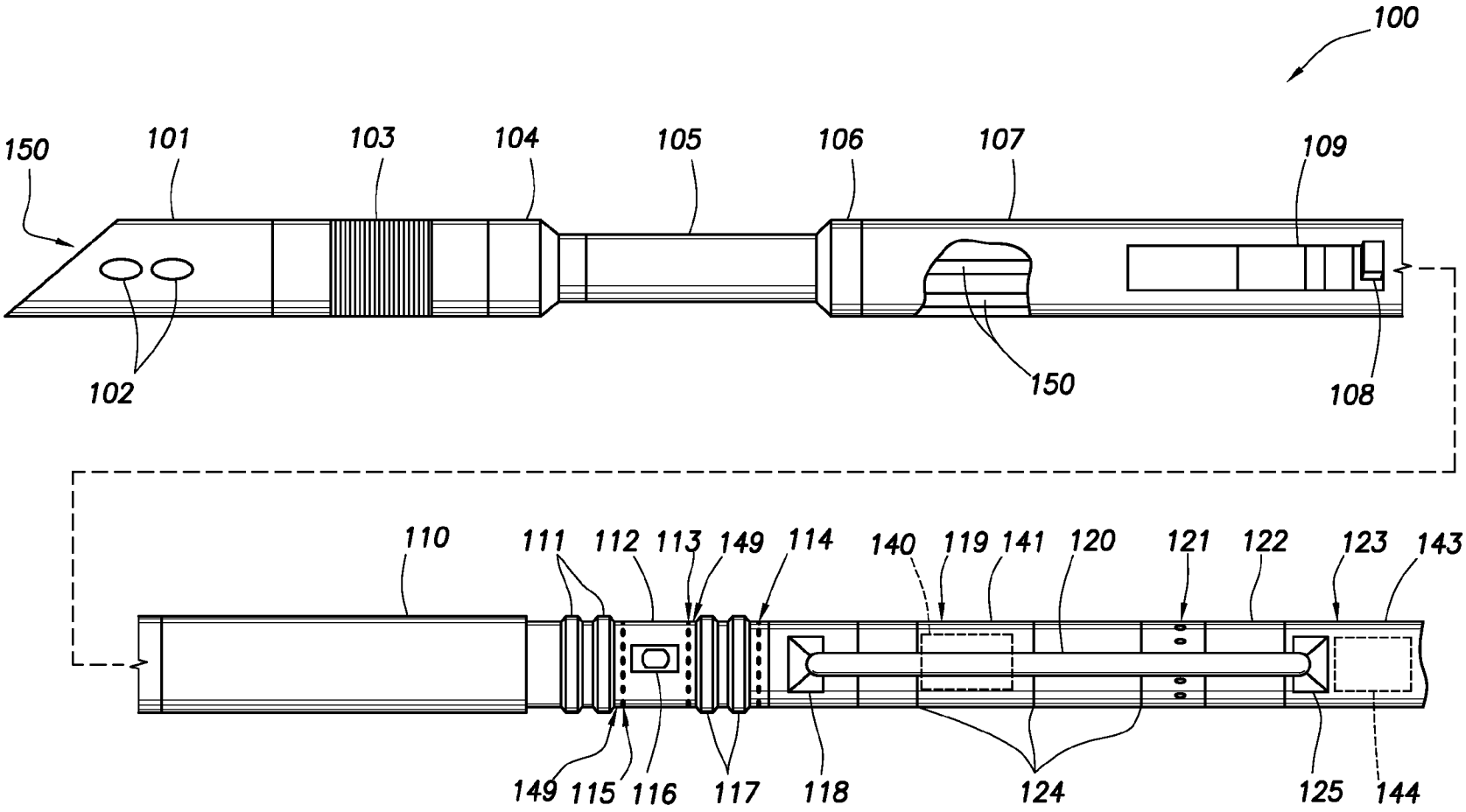
FIG. 4 is a schematic view of a tubing string with landing collar and primary wet-connect according to an aspect of the invention.
Figure 5:
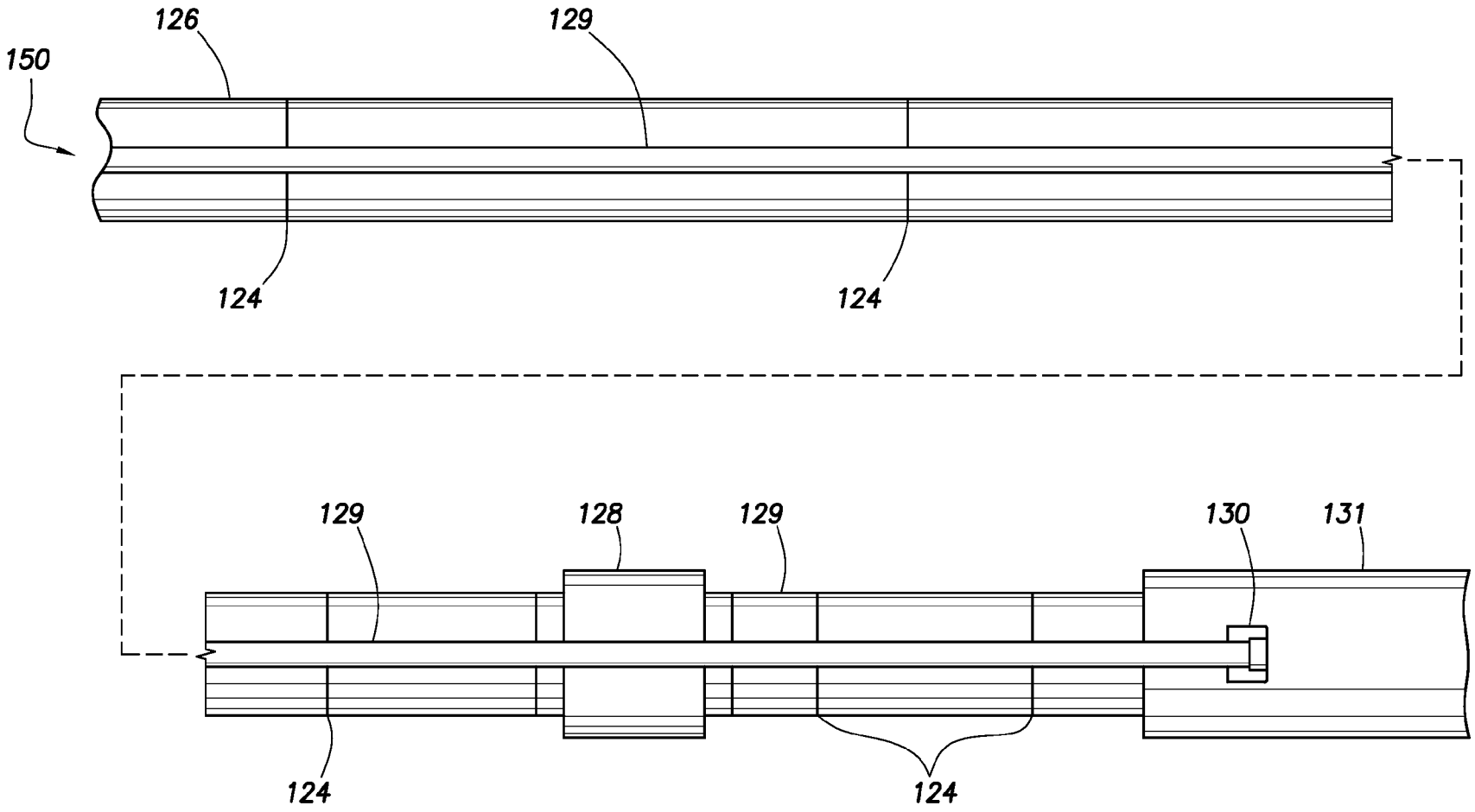
FIG. 5 is a schematic view of a tubing string with landing collar sub according to an aspect of the invention.

FIGS. 4 and 5 present an additional embodiment which utilizes an electrical wet-connect rather than inductive coils to enable power transference to the insertion string and ESP motor. FIGS. 4 and 5 present an exemplary embodiment of the disclosed apparatus seen in a schematic view. The figures are discussed in conjunction. FIG. 4 is a schematic view of an exemplary embodiment of an insertion string 100 for inserting an ESP assembly 119, including an ESP, electric motor assembly 123 and motor 144, and wet-connect 116, into a tubing string 126 at a downhole location, the tubing string having a cooperating wet-connect 130. FIG. 5 is a schematic view of a tubing string 126, with landing collar sub 128, and cooperating wet-connect 130 for use in conjunction with the insertion string 101 of FIG. 4.

Many of the other string components are the same as or similar to those described above in relation to FIGS. 2 and 3.

FIGS. 4 and 5 present an additional embodiment which utilizes an electrical wet-connect rather than inductive coils to enable power transference to the insertion string and ESP motor. FIGS. 4 and 5 present an exemplary embodiment of the disclosed apparatus seen in a schematic view. The figures are discussed in conjunction. FIG. 4 is a schematic view of an exemplary embodiment of an insertion string 100 for inserting an ESP assembly 119, including an ESP, electric motor assembly 123 and motor 144, and wet-connect 116, into a tubing string 126 at a downhole location, the tubing string having a cooperating wet-connect 130. FIG. 5 is a schematic view of a tubing string 126, with landing collar sub 128, and cooperating wet-connect 130 for use in conjunction with the insertion string 100 of FIG. 4.

FIG. 4 shows an exemplary insertion string 100. At its upper end, the string includes a connector assembly 101 for connecting the insertion string to a conveyance device, such as a wireline, slick-line, jointed tubing string, etc., typically via a setting or running tool. The connection can be made to additional downhole tools, such as standard MLT running tools such as a hydraulic retrieval tool (HRT), or standard wireline or slick-line setting tools. In the preferred embodiment, the connector sub is an orientation, retrieval sub 101 having an orientation mechanism, such as the angled upper surface or mule shoe. The sub connects to the conveyance mechanism by keyhole ports 102 which cooperate with radially extending dogs on the connecting tool above.

An annular isolation device 103 is positioned on the exterior of the insertion string assembly and, upon activation or setting, expands radially to seal and grip the tubing string. The annular isolation device provides a pressure seal across the annulus defined between the insertion string and the tubing string. Annular isolation devices include packers, inflatable packers, swellable packers, etc., and can employ one or more sealing elements, typically but not necessarily of elastomeric material, and gripping mechanisms such as radially expandable grips. Such devices are known in the art.

In a preferred embodiment, the insertion string is provided with one or more emergency or alternate disconnect assemblies 105, which can be attached via adapter subs 104 and 106. Emergency or contingency disconnection assemblies are known in the art by persons of skill in the art.

A latching assembly 107 is provided for selectively attaching the insertion string to the tubing string. Latching assemblies are known in the art and include expandable collets, spring-loaded locking or mating dogs, snap rings, split rings, cooperating profiles, etc., and also include various anchoring mechanisms. In a preferred embodiment, the latching assembly is a collet assembly. The collet assembly includes a radially adjusting collet 108. An internal, locking mandrel 109 serves to selectively lock the set collet into place, anchored or attached to the tubing string. Preferably the locking mandrel 109 has longitudinally extending splines 150 which cooperate with splines defined on the interior of the collet housing 107. The splines cooperate to prevent relative rotation of the housing and mandrel in response to torque placed on the assembly, for example, by the operation of the motor 144.

Annular seals 111 and 117 are positioned or defined on the exterior of the insertion assembly. The seals cooperate with the interior surface of the tubing string, profiles defined thereon, or cooperating seals positioned therein. Alternately, the seals can be carried on the interior of the tubing string. The seals operate to define a protective chamber for the electrical wet-connect port 116, after they are positioned sealingly in the tubing string. The protective chamber is defined in the annulus between the insertion and tubing strings and at each end by the seals 111 and 117. Consequently, the chamber extends longitudinally across one or more wet-connect ports. The protective chamber is preferably filled with a non-conductive and non-corrosive fluid to enhance connectivity.

In a preferred embodiment, the insertion string includes a fluid flush assembly 110 for flushing a cleansing or protective fluid, stored in a reservoir on the insertion string, across the wet-connect 116 and filling the protective chamber. Entry for the fluid to the protective chamber is provided by a plurality of inlets 115. Outlets 113 are provided for egress of the flushed wellbore fluid, which flows via internal passageway to exhaust ports 114. The flush assembly is preferably operated by driving an annular piston to force the protective fluid out of an annular reservoir containing the fluid and into the protective chamber via appropriate fluid passageways extending from reservoir to chamber.

Preferably, the piston is driven using weight-down on the coiled tubing to shear a pin or other holding mechanism and move the piston. Various fluid flush assemblies and methods are known in the art, for washing, cleaning, or lubricating a surface of interest. Persons of skill in the art will recognize various such assemblies which can be used.

The assembly includes at least one electrical wet-connector port 116 which cooperates with a corresponding wet-connect port on the interior surface of the tubing string. The art known to the practitioner provides numerous mechanisms and methods of providing reliable wet-connector, whether electrical or fiber-optic.

The wet-connect 116 is connected, via internal wiring and electrical port 118, to the ESP assembly 119. The ESP assembly 119 includes an ESP 140 positioned in an ESP housing 141. ESPs are known in the art, as well as means for operatively attaching them to an electrical motor, drive shaft, electrical cables, etc., and will not be discussed herein. Persons of skill in the art are aware of the types of and specifications for ESPs.

Power from the wet-connect 116 is directed through port 118 and along cable 120 to the ESP motor 144 located near the bottom of the insertion string. The motor 144 is electrically powered and drives an ESP 118 that pumps surrounding fluid from the annulus exterior the pump housing 141, through intake ports 121, and up an interior passageway 150 to the surface.

An electrical port 118 connects to an exterior power cable 120, held in place, if necessary, by cable straps 124. The power cable enters the motor housing 143 of the motor assembly 123 via electrical connector port 125 and electrically powers the electric ESP motor 144.

Electric motors for use in powering ESPs are well known in the art by persons of skill therein. The ESP motor 144 is oil-filled and is preferably an induction style motor such as the motors supplied by the Wood Group. Power is fed to the motor via the motor electrical connector port 125, in this case located on the outside of the housing.

The ESP motor sub 123 it is connected to a rotary seal sub 122. The rotary seal sub ensures wellbore fluids do not enter the motor cavity, which is generally filled with oil. Such seal subs are known in the art and commercially available, such as from the Wood Group PLC. The shaft from the ESP motor runs through the seal sub and attaches to the ESP 140. The pump has fluid intakes 121 above the seal sub 122. The tubular members in the insertion string above the pump are preferably through-bore, defining a passageway, with an outlet at the upper end from the orientation retrieval sub 101.

The tubing string 126, seen in FIG. 5, is positioned downhole and anchored in place. The string can include various additional tools hanging below or extending above the illustrated portion of the string. The long-haul power cable 129 runs to the surface, where it is ultimately connected to a power source that energizes the ESP motor 144. The long-haul power cable 129 is strapped to the outside of the tubing string 126 using straps or steel bands 124 at appropriate intervals, as necessary. The speed of the motor is generally adjusted at the surface by varying frequency and voltage levels. The power is typically a three-phase alternating current operating at 50 Hz or 60 Hz under normal load conditions.

Generally, the configuration shown in FIGS. 4 and 5 enables electrical power transference from a long-haul power cable running from the surface along tubing string 126 to a power line 120 on the insertion string 100 by way of a wet-connect power coupling. The insertion string operates to insert, retrieve, and re-insert the ESP and ESP motor as necessary through the aid of standard running or setting tools. Generally ESPs last about 5 years between servicing, and in the event of sand ingression, servicing intervals can be reduced dramatically.

In use, preferably, the insertion string is placed in the tubing string utilizing coiled tubing and a coiled tubing rig with a Sperry hydraulic retrieving tool (HRT). The HRT is connected to the coiled tubing and engaged to the insertion string by mating retractable dogs with the keyhole ports 102. The mule shoe allows alignment of dogs and keyholes.

The insertion string is tripped into the wellbore. Eventually the locking collet 108 lands in the landing sub 128 radially expands into engagement with the landing sub. The collet arms (or similar), radially expanded, now bear the weight of the coiled tubing.

The upper and lower seals 111 and 117 seal against the tubing string, forming the annular protective chamber which extends across wet-connect part 116. The cooperating wet-connect of the tubing string is also in the sealed chamber. The protective chamber is isolated from wellbore fluids, however, the fluid in the chamber still contains wellbore fluids and needs to be flushed out and filled with a protective fluid.

When the locking collet 108 expands, a locking mandrel 109 moves beneath the collet fingers. Weight-down applied by the coiled tubing increases to shear a shear pin holding the locking mandrel in place. The locking mandrel travels beneath the collet fingers, essentially "locking" the collet in the radially expanded and engaged position.

The mandrel in a preferred embodiment engages an annular piston, as explained with reference to FIGS. 2 and 3. The flushing fluid enters the chamber through the intake ports 115. The fluid pushes wellbore fluid out the exit ports 113. Wellbore fluid is ejected out into the wellbore from the fluid exhaust ports 114. Check valves 149 and debris screens can be employed as well.

The upper part of the locking mandrel 109 inside the collet housing has splines 150 which cooperate with corresponding features on the inner diameter of the collet housing. This prevents the lower assembly from rotating due to reactive torque put into the insertion string by the ESP motor 144.

When the stroke of the mandrel 109 is complete, weight down from the coiled tubing sets the through-bore packer 103. The through-bore packer seals the wellbore from the tubing string inner diameter above it, allowing fluid pumped by the ESP to remain in the tubing string and travel up the well. The packer also prevents the insertion string from rotating due to reactive torque from the ESP motor.

Further disclosure relating to retrievable downhole ESPs can be found in the following, which are incorporated herein by reference for all purposes: U.S. Pat. No. 5,746,582, to Patterson, issued May 5, 1998; and U.S. Pat. No. 5,954,483, to Tetzlaff, issued Sep. 21, 1999.

The embodiments disclosed above are exemplary and persons of skill in the art will recognize variations, modifications, and additions which can be made without departing from the spirit of the disclosure. The apparatus described are for use in a method of servicing a wellbore extending through a subterranean wellbore. It is anticipated that the tubing string is previously positioned in the wellbore and that the insertion string is to be inserted into and attached to the tubing string. The insertion string is disconnected from the coiled tubing, wireline, etc., leaving an operable and powered ESP motor and ESP at the downhole location. The ESP and ESP motor are retrievable without having to also retrieve any of the tubing string. The tubing string can have many configurations and tools positioned above and/or below the landing sub (or other point of attachment for the insertion string), such as production tubing, screens, safety valves, production valves, in-flow control devices, etc.

Exemplary methods of use are discussed below and herein. The methods can have any number of steps, in various orders, with some listed steps skipped, repeated, or performed in different order, and additional steps can be added. The claims define the invention and the methods disclosed are not limiting. Neither the claims nor the disclosure limit the order of steps unless otherwise indicated (such as be "and then" or other verbiage requiring a specific order), nor do steps listed sequentially (or modified by terms such as "and then") necessarily need to be performed without intervening steps.

A method is presented for insertion of a retrievable ESP and electrical motor for driving the ESP, into a subterranean wellbore extending through a formation, the method comprising the steps of: a) running into the wellbore on a conveyance, to a downhole location, an insertion string having: an ESP, an electric motor for driving the ESP, and an electrical connector for receiving electrical power to operate the electric motor; and then b) attaching the insertion string to a tubing string positioned at the downhole location, the tubing string having a power cable for providing electrical power from the surface, the power cable having an electrical connector corresponding to the electrical connector of the insertion string for delivering electrical power to operate the electric motor; and then c) powering the electrical motor for driving the ESP utilizing the power cable and electrical connectors. Step a) can further comprise attaching the insertion string to, and lowering the insertion string on the conveyance, and wherein the conveyance is a wireline, slick-line, or coiled tubing. The step b) can further comprise connecting the electrical connector of the insertion string and the electrical connector of the tubing string to one another. The electrical connectors can be electrical wet-connect connectors or inductive windings. Where inductive windings are employed, the inductive windings can be mounted on the interior and/or exterior of the insertion string and/or tubing string, and the windings can take various arrangements. Step b) can further comprise sealing the electrical connectors in a fluid chamber defined between the insertion string and tubing string, and can further include creating at least one annular seal in an annulus between the tubing and insertion strings. Where a fluid chamber is created, the method can also include steps of substantially filling the fluid chamber with a non-corrosive, non-conducting fluid and/or substantially flushing wellbore fluid out of the fluid chamber. Step b) can further comprise attaching the insertion string to a landing sub on the tubing string; and can further comprise latching a latching device to a cooperating profile defined on the tubing string. The latching mechanism can be or include a collet assembly, a collet, a radially expandable collet, a radially collapsible collet, etc. The method can include radially expanding a collet, landing the collet on a landing sub or other profile, and/or locking the collet in an expanded state. The step b) can further comprise locking the insertion string to the tubing string. The locking can be accomplished by sliding a locking mandrel into a radially expanded collet. Further, the method can include setting an annular isolation device (such as a packer), positioned on the insertion string uphole of the ESP and electrical motor, to sealingly and grippingly engage the tubing string. The step b) can further comprise axially locking longitudinally movable members of the insertion string, such as with aligned splines on longitudinally movable (with respect to one another) members, such as the insertion string housing and an insertion string mandrel. One or both of the steps of filling and flushing the chamber can be done by moving a slidable piston, and forcing non-corrosive, non-conducting fluid out of a fluid reservoir and into the fluid chamber. The method can include the step of mating or connecting the electrical connectors of the insertion and tubing strings. The conveyance (wireline, coiled tubing, etc.) is disconnected from the insertion string once it is properly positioned and secured in place. The ESP motor is powered by electricity from the surface and passing down the long-haul power cable on the tubing string, through the mated electrical connectors (wet-connects or inductive coils), along cables or wiring on the insertion string and to the electric ESP motor. The motor drives the ESP. The ESP pumps wellbore fluid uphole to the surface. The insertion string, especially including the ESP and electrical motor are retrieved from the downhole location using a conveyance (wireline, etc.) when desired. The conveyance is lowered to the insertion string and attached thereto. In no particular order, the insertion string is disconnected or detached from the tubing string, the annular isolation device is un-set, the electrical connectors are disconnected, and the insertion string is pulled out of hole.

In the preferred and exemplary methods presented hereinabove, various method steps are disclosed, where the steps listed are not exclusive, can sometimes be skipped, or performed simultaneously, sequentially, or in varying or alternate orders with other steps (i.e., steps XYZ can be performed as XZY, YXZ, YZX, ZXY, etc.) (unless otherwise indicated), and wherein the order and performance of the steps is disclosed additionally by the claims appended hereto, which are incorporated by reference in their entirety into this specification for all purposes (including support of the claims) and/or which form a part of this specification, the method steps presented in the following text. Exemplary methods of use of the invention are described, with the understanding that the invention is determined and limited only by the claims. Those of skill in the art will recognize additional steps, different order of steps, and that not all steps need be performed to practice the inventive methods described.

While this invention has been described with reference to illustrative embodiments, this description is not intended to be construed in a limiting sense. Various modifications and combinations of the illustrative embodiments as well as other embodiments of the invention, will be apparent to person skilled in the art upon reference to the description. It is, therefore, intended that the appended claims encompass any such modifications or embodiments.

It is claimed:

1. A method for insertion of a retrievable Electric Submersible Pump (ESP) and electrical motor for driving the ESP, in a subterranean wellbore extending through a formation, the method comprising:

a) running into the wellbore on a conveyance, to a downhole location, an insertion string having: an inner transformer winding, an ESP, an electric motor for driving the ESP, and an electrical connector for receiving electrical power to operate the electric motor; and then b) attaching the insertion string to a tubing string positioned at the downhole location, the tubing string comprising an outer transformer winding and a power cable for providing electrical power from the surface, the power cable having an electrical connector corresponding to the electrical connector of the insertion string for delivering electrical power to operate the electric motor, wherein the inner transformer winding is aligned with the outer transformer winding to couple electromagnetic energy between the inner transformer winding and the outer transformer winding; and then c) powering the electrical motor for driving the ESP utilizing the power cable and electrical connectors.

2. The method of claim 1, wherein step a) further comprises: attaching the insertion string to, and lowering the insertion string on the conveyance, and wherein the conveyance is a wireline, slick-line, or coiled tubing.

3. The method of claim 1, wherein step b) further comprises: connecting the electrical connector of the insertion string and the electrical connector of the tubing string.

4. The method of claim 1, wherein the electrical connectors are electrical wet-connect connectors or inductive windings.

5. The method of claim 4, wherein step b) further comprises: sealing the electrical connectors in a fluid chamber defined between the insertion string and tubing string.

6. The method of claim 5, wherein the step of sealing further comprises creating at least one annular seal in an annulus between the tubing and insertion strings.

7. The method of claim 5, wherein step b) further comprises the step of: substantially filling the fluid chamber with a non-corrosive, non-conducting fluid.

8. The method of claim 7, wherein the step b) further comprises: substantially flushing wellbore fluid out of the fluid chamber.

9. The method of claim 8, wherein the steps of filling and flushing further comprise the step of: moving a slidable piston, forcing the non-corrosive, non-conducting fluid out of a fluid reservoir and into the fluid chamber.

10. The method of claim 1, wherein step b) further comprises attaching the insertion string to a landing sub on the tubing string.

11. The method of claim 10, wherein step b) further comprises latching a latching device to a cooperating profile defined on the tubing string.

12. The method of claim 10, wherein step b) further comprises radially expanding a collet and landing the collet on the landing sub.

13. The method of claim 1, wherein step b) further comprises locking the insertion string to the tubing string.

14. The method of claim 13, wherein step b) further comprises sliding a locking mandrel into the radially expanded collet.

15. The method of claim 1, wherein step b) further comprises setting an annular isolation device, positioned on the insertion string uphole of the ESP and electrical motor, to sealingly and grippingly engage the tubing string.

16. The method of claim 1, wherein step b) further comprises axially locking longitudinally movable members of the insertion string.

17. The method of claim 16, wherein the step of axially locking includes aligning cooperating splines of the longitudinally movable members.

18. The method of claim 1, wherein step b) further comprises mating the electrical connectors.

19. The method of claim 1, further comprising a step of: disconnecting the conveyance from the insertion string and pulling the conveyance from the wellbore.

20. The method of claim 1, further comprising a step d) of driving the ESP with the electrical motor.

21. The method of claim 20, further comprising a step e) of pumping formation fluid to the surface using the ESP.

22. The method of claim 1, further comprising a step f) of retrieving the insertion string to the surface for repair or replacement of at least one of the ESP or electrical motor.

* * * * *